United States Patent [19]

Diffrient

[11] Patent Number: 4,827,850

[45] Date of Patent: May 9, 1989

[54] TABLE WITH FOLDING MODESTY PANEL

[75] Inventor: Niels Diffrient, Ridgefield, Conn.

[73] Assignee: Howe Furniture Corporation, Trumbull, Conn.

[21] Appl. No.: 252,166

[22] Filed: Sep. 30, 1988

[51] Int. Cl.[4] ..... A47B 57/00

[52] U.S. Cl. ..... 108/60; 108/50; 108/69

[58] Field of Search ..... 108/60, 25, 13, 50, 108/69, 86, 14, 140, 143, 145, 59, 71, 72, 73, 76; 248/240; 312/194, 195, 223; 16/280, 255, 257, 293, 281

[56] References Cited

U.S. PATENT DOCUMENTS

| | | | |
|---|---|---|---|
| 1,842,954 | 1/1932 | Anderson | 248/240 |
| 2,294,575 | 9/1942 | Schneider | 16/293 X |
| 3,034,153 | 5/1962 | Sargen | 108/25 X |
| 3,117,535 | 1/1964 | Hendrickson | 108/60 |
| 4,163,592 | 8/1979 | Nelson | 312/194 |
| 4,168,870 | 9/1979 | Hill | 312/223 |
| 4,550,666 | 11/1985 | Suoboda | 108/145 X |
| 4,646,654 | 3/1987 | Sullivan | 108/69 |
| 4,690,468 | 9/1987 | Lau | 16/293 X |
| 4,734,826 | 3/1988 | Wilson et al. | 312/223 X |
| 4,750,432 | 6/1988 | McNamara et al. | 108/69 |

*Primary Examiner*—Kenneth J. Dorner
*Assistant Examiner*—José V. Chen
*Attorney, Agent, or Firm*—Parmelee, Bollinger & Bramblett

[57] ABSTRACT

A folding modesty panel on the edge of a table surface is maintained in either an extended, vertical, position or a folded, horizontal, position by a single spring or set of springs. The panel may be utilized as a wire manager by the provision of a flexible mesh trough connected between the bottom of the panel and the underside of the table top. An access cover on the front of the panel permits access to the contents of the trough and conceals its contents when closed.

10 Claims, 6 Drawing Sheets

TABLE WITH FOLDING MODESTY PANEL

TECHNICAL FIELD

This invention relates to the field of folding furniture. More particularly, it pertains to a table having a folding modesty panel. The invention also pertains to such a table wherein the modesty panel serves the additional function of a wire manager for electrical equipment sitting on the table.

BACKGROUND ART

Modesty panels are widely used on tables, particularly on work tables and desks. Normally, they are simply fixed panels and, in some instances, they may be folding panels designed to be folded beneath the table top for storage or other reasons. When they are foldable, they are normally provided with some type of catch for holding them in the folded position. Another catch or spring would then be employed to hold them in their normal, unfolded, position.

DISCLOSURE OF INVENTION

The invention is a table having a top with a folding modesty panel carried beneath one edge. The panel is designed in such a fashion that a single spring, or set of springs, serves to hold it in both its folded position on the underside of the table top or in its downwardly extended position. In one version, the folding modesty panel also serves as a wire manager. There is a wire-supporting trough formed by a flexible mesh secured to the rear of the panel at its bottom and a hinged access cover carried by the front of the panel. When the panel is in its down, or unfolded, position the trough carries and conceals electrical wires from equipment on the table top. However, when empty, the trough does not interfere with the capability of the panel being folded against the underside of the table top.

BEST MODE FOR CARRYING OUT THE INVENTION

Figure 1:
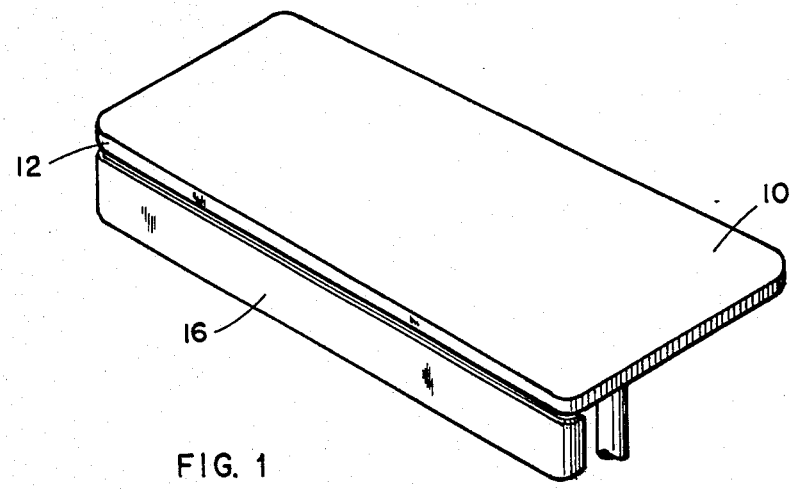
FIG. 1 is a perspective view of a table top in accordance with the invention with the modesty panel extended.
Figure 2:
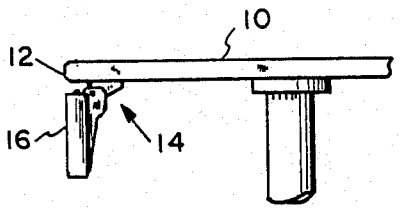
FIG. 2 is a partial elevational view of the table of FIG. 1.
Figure 3:
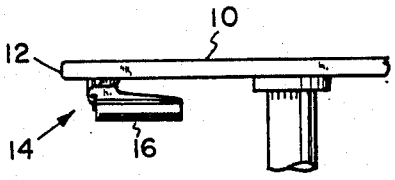
FIG. 3 is a view similar to that of FIG. 2, showing the modesty panel in its folded position.

FIG. 1 illustrates a table having a top 10 and a substantially straight edge 12. Mounted to the underside of the table top 10 and along the edge 12, by means of a hinge assembly 14, is a modesty panel 16. During normal use, the modesty panel 16 will hang downwardly from the edge 12 as illustrated in FIG. 2. However, for purposes of storage, moving, clearance, or for other reasons, it may be folded upwardly against the underside of table top 10, as illustrated in FIG. 3.

Figure 4:
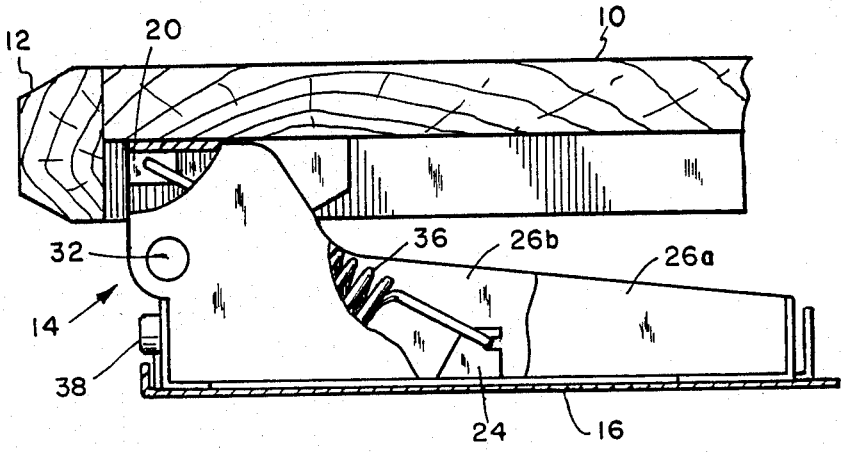
FIG. 4 is an enlarged elevational view of the folded modesty panel of the invention, shown partially broken away.
Figure 5:
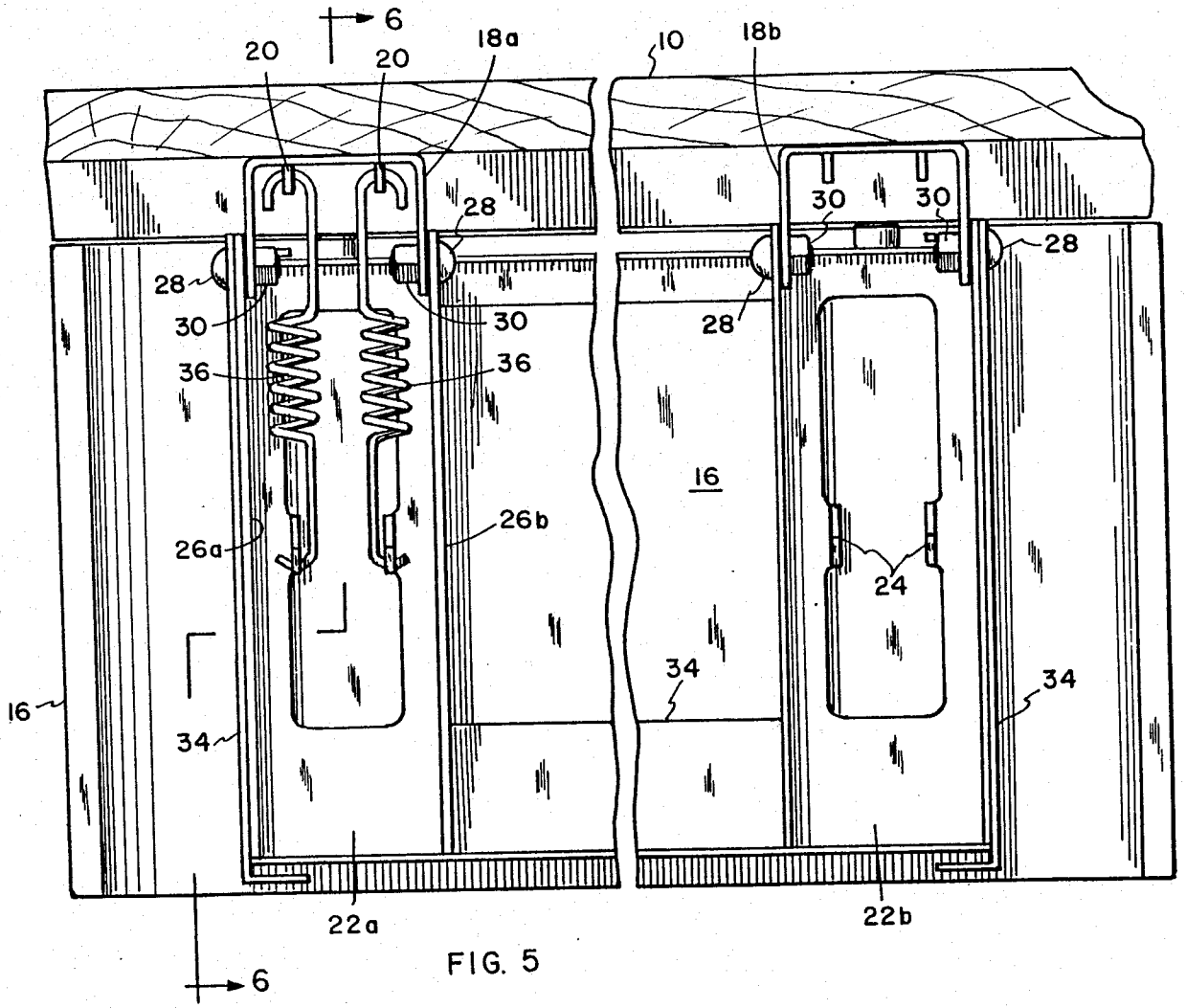
FIG. 5 is a rear view of the modesty panel in its extended position.
Figure 6:
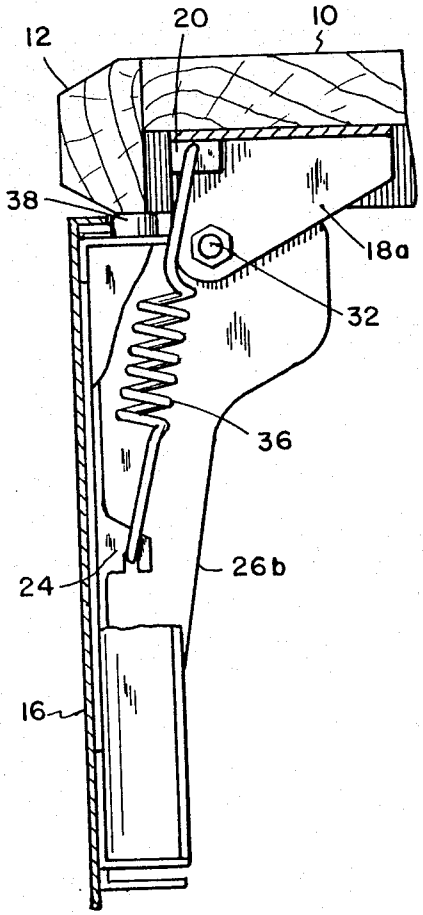
FIG. 6 is a cross-section taken substantially along the line 6—6 of FIG. 5.

The construction of the modesty panel and hinge assembly are illustrated in more detail in FIGS. 4–6. As seen therein, the table top edge 12 is a separate strip which extends downwardly slightly below the bottom surface of table top 10. The hinge assembly 14 comprises a pair of identical U-shaped brackets, 18*a*, 18*b* which are mounted to the underside of table top 10 as shown in FIG. 5. The base portion of each of the brackets 18 is pierced and bent to form a pair of eyelet tabs 20.

Spot welded to the rear of the modesty panel 16, are a pair of identical panel brackets 22*a*, 22*b*. Each of the brackets 22 is substantially U-shaped in cross-section. The central portion of each of their base members is cut away and bent to form a pair of raised tab hooks 24. Their parallel sides 26*a*, 26*b* are tapered and enlarged at one end. They are pivotally connected to the legs of the respective brackets 18*a*, 18*b* by bolts 28 and nuts 30 so as to pivot about an axis 32 (FIGS. 4 and 6). In addition to the foregoing, the panel 16 may carry various stiffening members 34 which need not be further described.

Completing the assembly are one or more coiled tension springs 36. The illustrated embodiment employs one pair of such springs connected in one of the panel brackets 22*a*. One or two similar springs could also be connected into the other panel bracket 22*b*. As illustrated, one hooked end of each of the springs 36, is connected to one of the eyelet tabs 20 which is, in effect, connected to the table top 10. The other end of each tension spring is connected to one of the tab hooks 24 which is mounted on the rear of the modesty panel 16. Mounted along the inside or table abutting edge of the modesty panel 16 are a pair of rubber bumpers 38.

By means of this construction, the modesty panel 16 will depend directly downwardly from the edge 12 of the table 10, as shown in FIG. 6, or may be pivoted about the pivot axis 32 into a horizontal position beneath table top 10 as shown in FIG. 4. It is important to note that the spring 36 is so located that, in passing between the positions illustrated in FIGS. 4 and 6, it crosses the pivot axis 32. As a result, the same spring or set of springs serves to maintain the modesty panel 16 in each position. In the folded position of FIG. 4, the springs 36 maintain the modesty panel 16 in such folded position. On the other hand, when the modesty panel is extended, as shown in FIG. 6, the spring 36 being on the opposite side of the pivot axis 32 serves to maintain the panel in the extended position.

Figure 7:
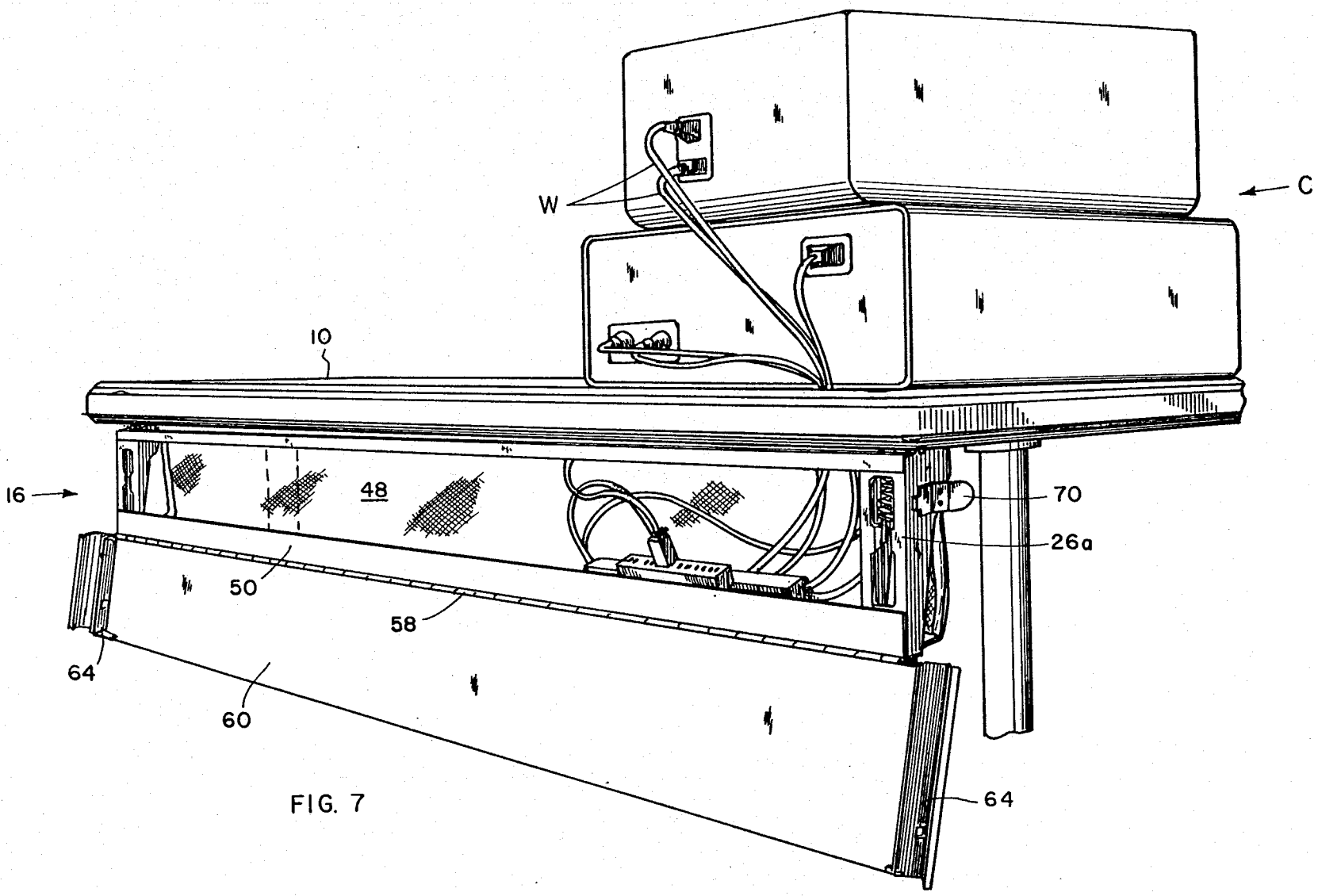
FIG. 7 is a perspective view of the wire manager version of the invention with the access cover open.

FIG. 7 illustrates a table top 10 wherein the modesty panel 16 also functions as a wire manager for wires W from computers C or other electrical equipment which may be on the table. The modesty panel of FIGS. 7–12 is mounted to pivot in the same fashion as previously described. Accordingly, the pivoting mechanism will not be further described.

Figure 8:
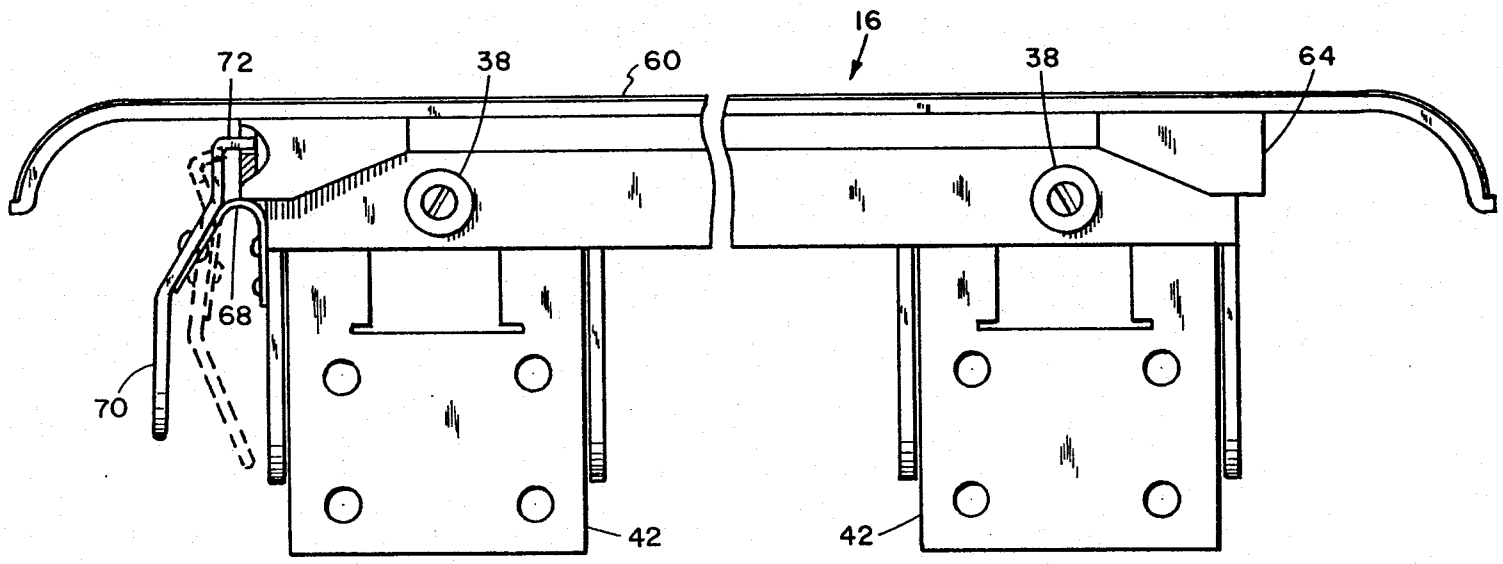
FIG. 8 is a plan view of the modesty panel of FIG. 7 with the table removed.
Figure 9:
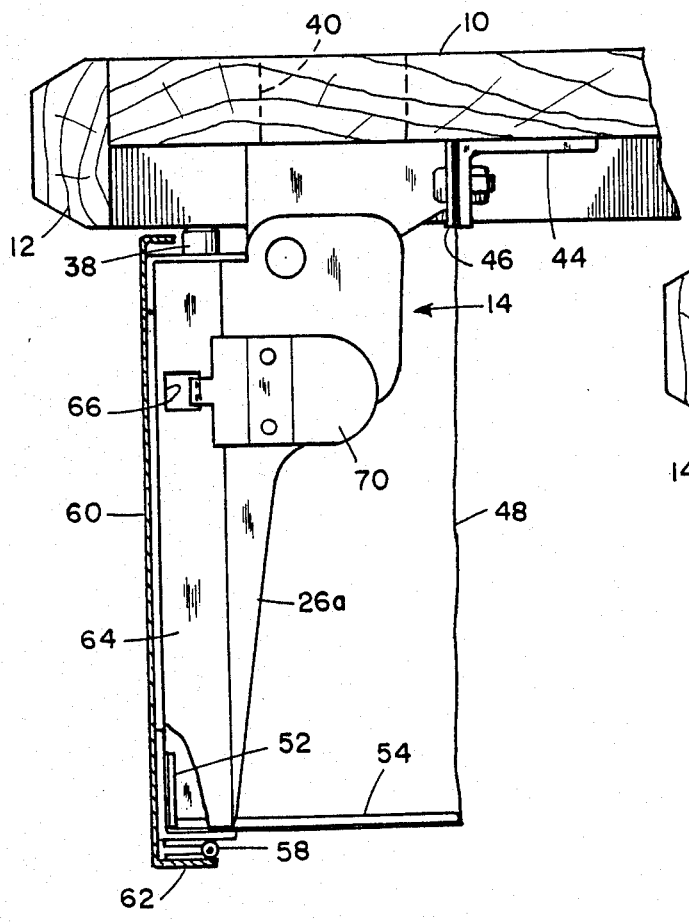
FIG. 9 is an end view of the panel of FIG. 8.
Figure 10:
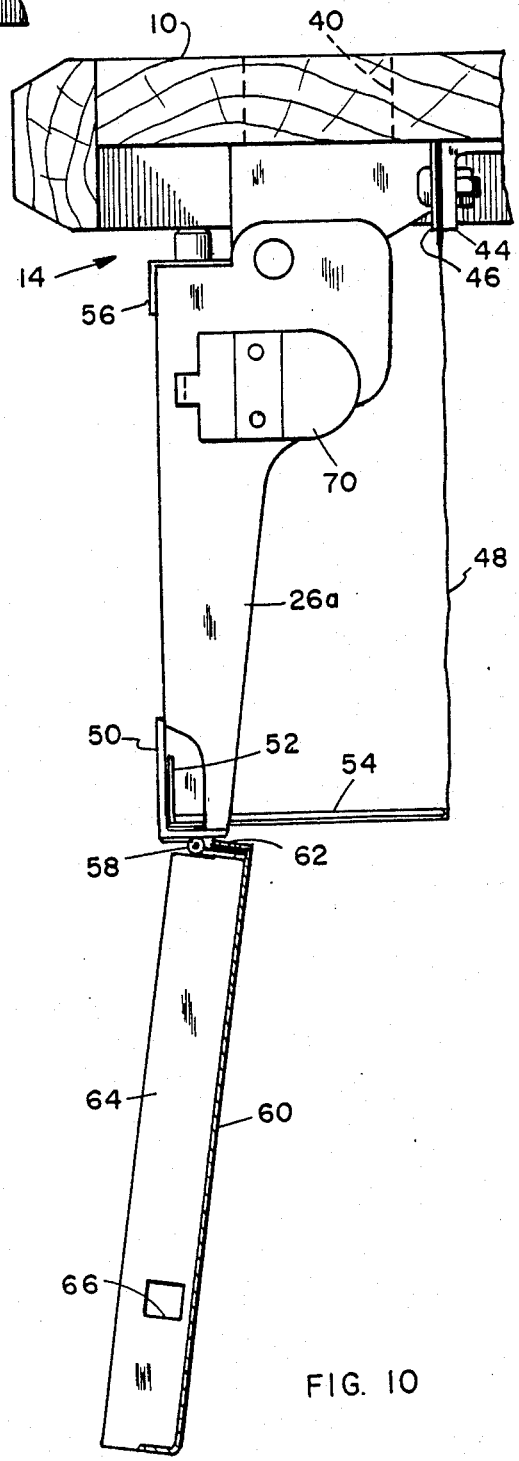
FIG. 10 is a view similar to that of FIG. 9, but showing the access cover open.
Figure 11:
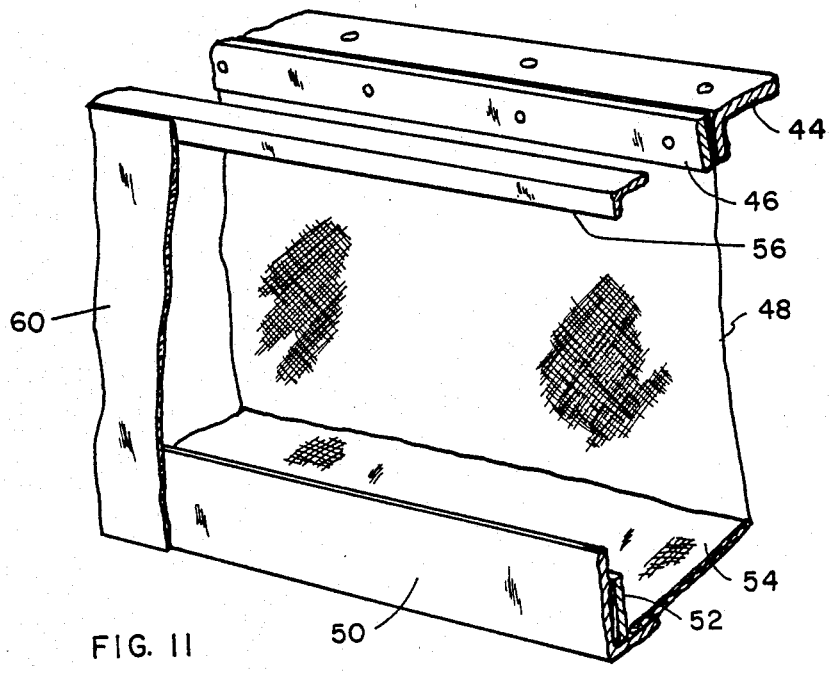
FIG. 11 is a cutaway perspective view, illustrating the construction of the wire trough of this invention.

In the embodiment of FIGS. 7–12, the table top 10 is provided with openings 40 (FIGS. 9 and 10) just above the hinge assembly 14. The modesty panel assembly 16 is secured to the underside of the table top 10 by brackets 42 (FIG. 8). Mounted to the underside of table top 10 and parallel with the modesty panel is an angle iron 44 (FIG. 9). A clamping strip 46 is mounted against the depending leg of angle iron 44 and secures one major edge of a flexible rectangular wire or plastic mesh 48. Extending between the sides 26 at each end of the modesty panel assembly 16, and along the bottom of the modesty panel, is a lower support member 50. The remaining major edge of the flexible mesh 48 is secured to the lower support member 50 by means of a lower clamping strip 52. Carried within the mesh 48 is a long, narrow, thin rectangular shelf 54 which may be of plastic or composition board or the like. Also extending between the ends 26 of the panel assembly is an upper panel support rail 56.

Mounted to the bottom of the lower support member 50 is a piano hinge 58. The front of the modesty panel assembly 16 is normally losed by an access cover 60. As viewed in FIG. 9, the access cover 60 has a lower edge 62 which is connected to the piano hinge 58 and side panels 64 positioned to lie closely adjacent the outermost sides 26 at the extreme ends of the modesty panel 16. At least one of the side panels 64 is provided with a latching hole 66. Mounted at each end of the modesty panel 16 is a cantilevered spring 68 (FIG. 8). Mounted on spring 68 is a latch 70, bent at its end to form a latch hook 72 engageable with the corresponding latching hole 66 when the cover 60 is closed as shown in FIG. 9. As will be clear from the dotted line showing of FIG. 8, the latch is released by pressing against the force of spring 68 to the dotted line position.

OPERATION

As illustrated in FIG. 7, the wires W from table to devices such as computer C pass through suitably provided holes in the table top 10 to rest in the trough created by the flexible mesh 48 and the rigid shelf 54. Not only wires, but plug-in strips and other small devices may be contained within this trough. This adds not only to the aesthetic appearance, but also provides a safer work environment than if the wires were merely in tangles on the floor. In order to access the contents of the trough, it is merely necessary to release latch 70 and open the access cover 60.

Figure 12:
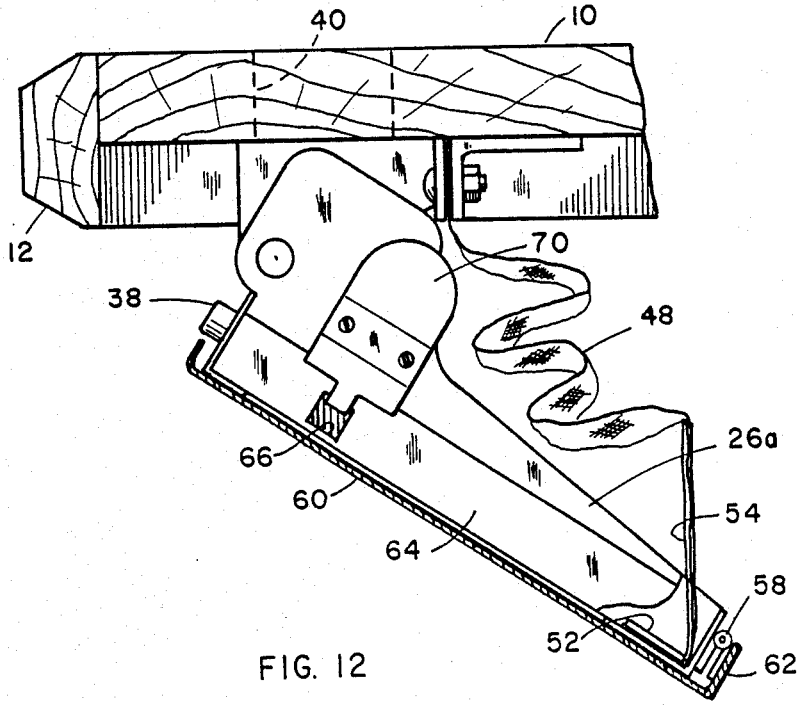
FIG. 12 is a view similar to that of FIG. 9, but showing the manner in which the wire trough folds.

The wire manager version of the modesty panel 16, when empty of wiring, may be folded in the same manner and with the same mechanisms as described in connection with FIGS. 1–6. This folding is permitted by the flexibility of the mesh trough 48. As illustrated in FIG. 12, it collapses readily and is stowed out of sight beneath the folded modesty panel assembly.

It is believed that the many advantages of this invention will now be apparent to those skilled in the art. It will also be apparent that a number of variations and modifications may be made therein without departing from its spirit and scope. Accordingly, the foregoing description is to be construed as illustrative only, rather than limiting. This invention is limited only by the scope of the following claims.

I claim:

1. In a table having a top with at least one substantially linear edge and a modesty panel adjacent said edge, the improvement which comprises:

hinge means connecting the modesty panel to said table top for positioning the modesty panel about an axis of rotation between a vertical, extended, position and a horizontal, folded, position beneath said table top; and an elongated tension spring having a first end connected to said table top and a second end connected to said modesty panel such that said spring passes through said axis of rotation when said modesty panel is moved from one of said vertical and horizontal positions to the other to thereby retain said modesty panel in either of said positions.

2. The improvement of claim 1 wherein said modesty panel, when in its vertical position, comprises a wire retaining trough adapted to enclose wires connected to equipment on said table top.

3. The improvement of claim 2 wherein said trough comprises:

a substantially rectangular frame member having first and second longer sides and first and second shorter ends, the first of its longer sides being connected to said hinge means;

a substantially rectangular flexible web having first and second longer sides, the first of its longer sides being connected to the underside of said table top and spaced from said frame member;

means for connecting the seoond longer side of said flexible web to the second longer side of said frame member whereby said web forms one side of said trough; and means carried by the second longer side of said frame member for forming the other side of said trough.

4. The improvement of claim 3 including access cover means for accessing the interior of said trough and for closing the frame member and concealing contents of said trough.

5. The improvement of claim 4 wherein said access cover means is hinged along the second longer side of said frame member.

6. The improvement of claim 3 wherein said trough includes a relatively rigid shelf member forming the bottom thereof when said modesty panel is in its extended position.

7. In a table having a top with at least one substantially linear edge, the improvement which comprises:

wire openings adjacent the linear edge of said table top;

a substantially rectangular frame formed of upper and lower support members and first and second end brackets;

means for mounting said rectangular frame to the underside of said table top adjacent said linear edge for rotation about a substantially horizontal axis between a vertical, extended, position and a horizontal, folded position beneath said table top;

a flexible wire-supporting trough mounted to said rectangular frame and open to receive wires passing into it from said wire openings, said trough being compressible when empty to permit said rectangular frame to assume its folded position; and access cover means for closing said frame and concealing contents of said trough.

8. The improvement of claim 7 wherein said mounting means comprises:

a hinge connected to said table top and to at least one of said end brackets;

an elongated tension spring having a first end connected to said table top and a second end connected to said end bracket such that said spring passes through said axis of rotation when said frame is moved from one of said vertical and horizontal positions to the other to thereby retain said frame in either of said positions.

9. The improvement of claim 7 wherein said access cover means is hinged to said lower support member.

10. The improvement of claim 8 wherein said access cover means is hinged to said lower support member.

* * * * *